US009752783B2

(12) United States Patent
Huang et al.

(10) Patent No.: US 9,752,783 B2
(45) Date of Patent: Sep. 5, 2017

(54) SMART DEVICE FOR GAS RANGE

(71) Applicants: Liji Huang, San Jose, CA (US); Chih-Chang Chen, Cupertino, CA (US)

(72) Inventors: Liji Huang, San Jose, CA (US); Chih-Chang Chen, Cupertino, CA (US)

(73) Assignee: Wisenstech Ltd., Santa Clara, CA (US)

( * ) Notice: Subject to any disclaimer, the term of this patent is extended or adjusted under 35 U.S.C. 154(b) by 325 days.

(21) Appl. No.: 14/621,043

(22) Filed: Feb. 12, 2015

(65) Prior Publication Data

US 2016/0238257 A1 Aug. 18, 2016

(51) Int. Cl.

| | |
|---|---|
| ***F24C 1/00*** | (2006.01) |
| ***F24C 3/12*** | (2006.01) |
| ***F23N 5/24*** | (2006.01) |

(52) U.S. Cl.

CPC ..... *F24C 3/126* (2013.01); *F23N 5/242* (2013.01); *F23N 2025/06* (2013.01); *F23N 2031/00* (2013.01); *F23N 2041/08* (2013.01); *F23N 2900/01001* (2013.01)

(58) Field of Classification Search

CPC ..... F23N 2025/06

USPC ..... 431/76, 18

See application file for complete search history.

(56) References Cited

U.S. PATENT DOCUMENTS

| | | | | |
|---|---|---|---|---|
| 4,916,437 | A * | 4/1990 | Gazzaz | F17D 5/02 251/129.01 |
| 5,908,980 | A * | 6/1999 | Hwang | G01M 3/2815 137/557 |
| 2006/0266228 | A1* | 11/2006 | Ritterling | A47J 37/067 99/450 |
| 2012/0019378 | A1* | 1/2012 | Watson | H04L 12/2825 340/539.1 |
| 2013/0260320 | A1* | 10/2013 | Townsend | F24C 7/08 431/2 |
| 2014/0159877 | A1* | 6/2014 | Huang | G08C 17/02 340/12.5 |
| 2015/0136760 | A1* | 5/2015 | Lima | H05B 6/705 219/709 |

* cited by examiner

*Primary Examiner* — Avinash Savani

(57) ABSTRACT

The design and assembly of a smart device constituent of a micro-machined (a.k.a. MEMS, Micro Electro Mechanical Systems) mass flow sensor and an electrically controllable valve for applications in safety enhancement and intermit connectivity for residential or commercial gas range is disclosed in the present invention. The said smart device detects the gas flow at the unattended situations and sends information to the destined mobile devices of the users via the network such that it enables the users to remotely execute actions of either shutting off the gas supply or call for relevant party's immediate attention. The said smart device shall also automatically shut off the gas supply should the transmitted signal to users failed to send feedback signal such that it can prevent the safety incidents due to leakage or overheating or even fires. The capability of the MEMS mass flow sensor shall also provide the thermal value measurement of the supplied gases and enable the user to program the gas range for making complete tasks of cooking substances in the unattended situation.

10 Claims, 3 Drawing Sheets

SMART DEVICE FOR GAS RANGE

BACKGROUND OF THE INVENTION

1. Field of the Invention

This invention relates to residential or commercial gas appliances. In particular, the invention relates to the smart gas range appliance that shall be equipped with electronic sensing element and can be remotely controlled by a mobile device. This invention is specifically for residential or commercial kitchen range that is operated with gas fuel. This invention is further related to micromachined silicon sensors or Micro Electro Mechanical Systems (MEMS) mass flow and gas sensing technology that measures the quality and quantity of gases. The present invention additionally relates to internet of things and the relay to the data clouding and analysis for which the smart range can transmit the data to the cloud via the mobile devices.

2. Description of the Related Art

It is always desirable to have a controllable device for residential or commercial appliances for safety, efficiency and intelligence purpose. While for an electrical heating apparatus or magnetic induction heating appliance that can provide direct electronic signals it is relatively easier to implement a control mechanism such as adding RFID sensing or temperature sensing elements, for example, U.S. Pat. No. 6,953,919 to Clothier, U.S. Pat. No. 7,255,100 to Pepper et al, and U.S. Pat. No. 5,951,500 to Smrke. Controlling the residential gas heating apparatus such as gas ranges with intelligent devices or modules is difficult, and relatively less disclosures could be found in literature. Akamatsu et al (U.S. Pat. No. 6,619,613) had proposed an apparatus that incorporated plurality of gas flow adjusting holes and step motors to adjust the openings of these holes such that different amount of gas can be delivered to the heating appliance. However, such an adjustment schedule shall only add the automation features in comparison to the existing vastly used adjustment mechanism with mechanical manual valves. Rothenberger and Weiss (U.S. Pat. No. 6,287,108) utilized a volumetric gas meter to provide the control of the gas opening valve such that the gas supply can be adjusted according to the desired gas volume. This approach is similar to the disclosure by Welz et al (U.S. Pat. No. 6,247,919) where flow meter is used to provide the control baseline for a constant gas supply to an industrial burner. These disclosures therefore provide only the control capability according to the gas flow volume but they failed to response when the gas thermal value associated to the gas supply sources or gas compositions is varied. A constant volume supply at such a circumstance shall hence not be desired. Barritt and Pickering (U.S. Pat. No. 8,475,162) have further disclosed a cooking gas burner system in which a pressure sensor was used to gauge the gas supply and provide data to control a valve that adjust the heat by the gas to the cooking gas burner system. Similar invention to Schultz and Bergum (U.S. Pat. No. 8,635,997) also adapted a pressure regulator to modulate a gas valve or valves together with an inducer air flow fan that shall be also modulated by a pressure regulator such that the gas or gas fired appliance could be operated at its maximum efficiency. Both the above inventions however also would not be capable to measure the gas thermal mass value and the regulated gas volume via the pressure information could be fault to the desired operating efficiency. As the gas supplied usually shall not be identical in its physical and chemical properties from place to place which means that a constant volume control approach would not be able to used when the gas supply changes, which is likely one of the reasons that such appliances are not available at present since in particular the residential gas metrology is realized by volumetric technology only as of today.

Therefore it is desired to have a completed new approach or disclosure of a control device for the gas appliances that shall perform the mass flow sensing with thermal value metrology capability for the desired control features, which adds values of intelligence to the residential or commercial gas appliances such as gas ranges. This device shall be able to work for most of the gas supplies regardless of the gas properties and maintain good accuracy and reliability. The desired device with control features by integrated with both a sensor having the mass flow sensing and gas thermal value metering and an electrically controllable on/off valve. The sensing element of the device shall also be capable of metering or monitoring the gas leakage or a constant flow at a preset level while the device interfaces via the networking with a mobile device that provides the remote control to the device. Further there should not be any safety limitations for the desired device that shall be able to readily applicable for most of the gas pipelines for either residential or commercial gas appliances.

SUMMARY OF THE INVENTION

It is the objective of this invention to provide the design and structure of a device for residential or commercial appliances using gas fuel such as gas ranges. The device is incorporated with a sensor having both gas mass flow sensing and gas thermal value metering, and a control valve. The device shall have the capability of interfacing with a mobile device for providing remote management including shut-off of the gas supply via the network. The said device is a safety device for the appliances using gaseous fuel but not a replacement for the appliance operation switches. Further this invention disclosed the detailed assembly of the said device.

In one preferred embodiment, the invented device is in particular designed for residential or commercial gas appliances using natural gas or equivalent gas fuel as the primary heating source, such as gas ranges. The said device shall have the capability of metering the gas mass flow and the corresponding thermal values as well as the capability of shut-off the gas supply by an integrated valve at a certain programmable control value through interfacing remotely with a mobile device via the network. The said device shall be installed in serial on the gas supply pipeline that connected to the appliances operating by the gaseous fuel. The metered gas flow rate shall be as low as that of a value equivalent to the manufacture set leakage alarm, for the enhancement of the appliance safety.

In another preferred embodiment, the invented device shall be an executable device having the gaseous fuel flow rate sensing elements integrated with an executable on/off valve. The flow rate sensing elements are preferred to be an integrated silicon mass flow sensor with gaseous fuel thermal value measurement capability that shall provide an instant data rate to the control electronics on the device. The said on/off valve is preferred to be a fuel gas safety proof plastic rubber electrical-mechanical valve operating at a low voltage of 5Vdc and below. The said valve could also be a pulse self-priming valve that again shall be gas fuel safety proof operating at a low voltage with a reliable lifetime guaranteed. The said valve shall be controlled by the same electronics that reading the operating the said silicon mass flow rate sensing and gaseous fuel thermal valve sensing elements. The said sensing elements shall provide the instant gaseous fuel flow rate and thermal value to the electronics for further processing or executing the said valve operations.

In another preferred embodiment, the invented device with the capability of metering the gaseous fuel is accomplished by a silicon mass flow sensor made via the micro electro mechanical system fabrication process having a fast response time and wide dynamic range. The said mass flow sensor shall utilize the thermal calorimetric sensing principle that shall be independent of the variations of the environmental parameters such as pressure and temperature. The said mass flow sensor can be the one disclosed by the same inventor (U.S. Pat. Nos. 7,752,910; 7,765,679), but the said mass flow sensor can be further integrated with a thermal conductivity sensing element and a thermal capacity sensing element for additional compensation of the metering accuracy when the gaseous fuel composition has variations. The said mass flow sensor shall be package inside the device flow channel and pre-calibrated for the desired accuracy.

In another preferred embodiment, the invented device shall be able to detect the potential leakage flow rate of the said appliances set by the manufacturer. Otherwise it shall be capable of measurement for any constant flow rate predetermined or pre-set at a desired time period by the users. The device shall evoke the remote mobile device via the network that such said leakage rate is presenting or the pre-set constant flow rate is overdue for the desired time period by the users. When the leakage state is detected or the desired time period for a constant flow rate is overdue, the said device shall signal to the remote mobile device via the network and the user can execute the gas supply shut-off procedure by remotely closing the constant open gaseous fuel valve integrated in the said device that is connected in serial with the appliance gas pipeline. In the preferred embodiment, the said device shall execute automatically the gas supply shut-off procedure for the ultimate safety and protections at a desired period of time when the signal to the remote mobile device returns no actions.

In another preferred embodiment, the said invented device shall have the capability of gaseous fuel flow rate metering that shall further have gaseous fuel thermal value measurement capability. While the flow rate metering can provide the leakage as well as gas appliance operation status, the thermal value measurement capability can be utilized to gauge the timing for the gas appliances in operation. In the preferred embodiment for gas ranges, the measurement of the timing for a desired substance cooked or heated to a desired condition shall be determined via the thermal value measurement by the said sensing elements for the specific gaseous fuel that provides the heating value for the said substance. Thereafter, the said device shall signal the status quo or condition in either percentage or remaining timing via the network to the desired remote mobile device further for a warning of possible performance overdue of the appliance. The said device shall also be capable to execute automatically the safety precautions when the overdue signals return no actions. The execution shall include but not limit to the execution of the gas supply shut-off by closing the integrated valve, and the addition route warning signals to the pre-set remote stations.

In yet at preferred embodiment, the invented device shall only be able to be reset on site to its constant open status at operation by the mobile device via the network when the gas supply to the appliance is terminated after valve close command is executed at the said conditions disclosed in the above. Further, the reset operation shall however be performed only after all the gas operation switches on the appliances by the original manufacturer are close tight. The remote reset capability of the device shall not be permitted for safety purpose.

For the current residential or commercial appliances operated with gaseous fuels, the present invention provides a solution for ultimate safety for overheating, unattended operation as well as gas leakage induced safety incidents. This invention further could provide the guidance for programmable appliances with use of a controllable proportional valve instead to those skilled in the art. This invention will no doubt become apparent to those skilled in the art after reading the following detailed description of the preferred embodiments that are illustrated in the accompanying drawings.

BRIEF DESCRIPTIONS OF THE DRAWINGS

DETAILED DESCRIPTION OF THE PREFERRED EMBODIMENTS

Figure 1:
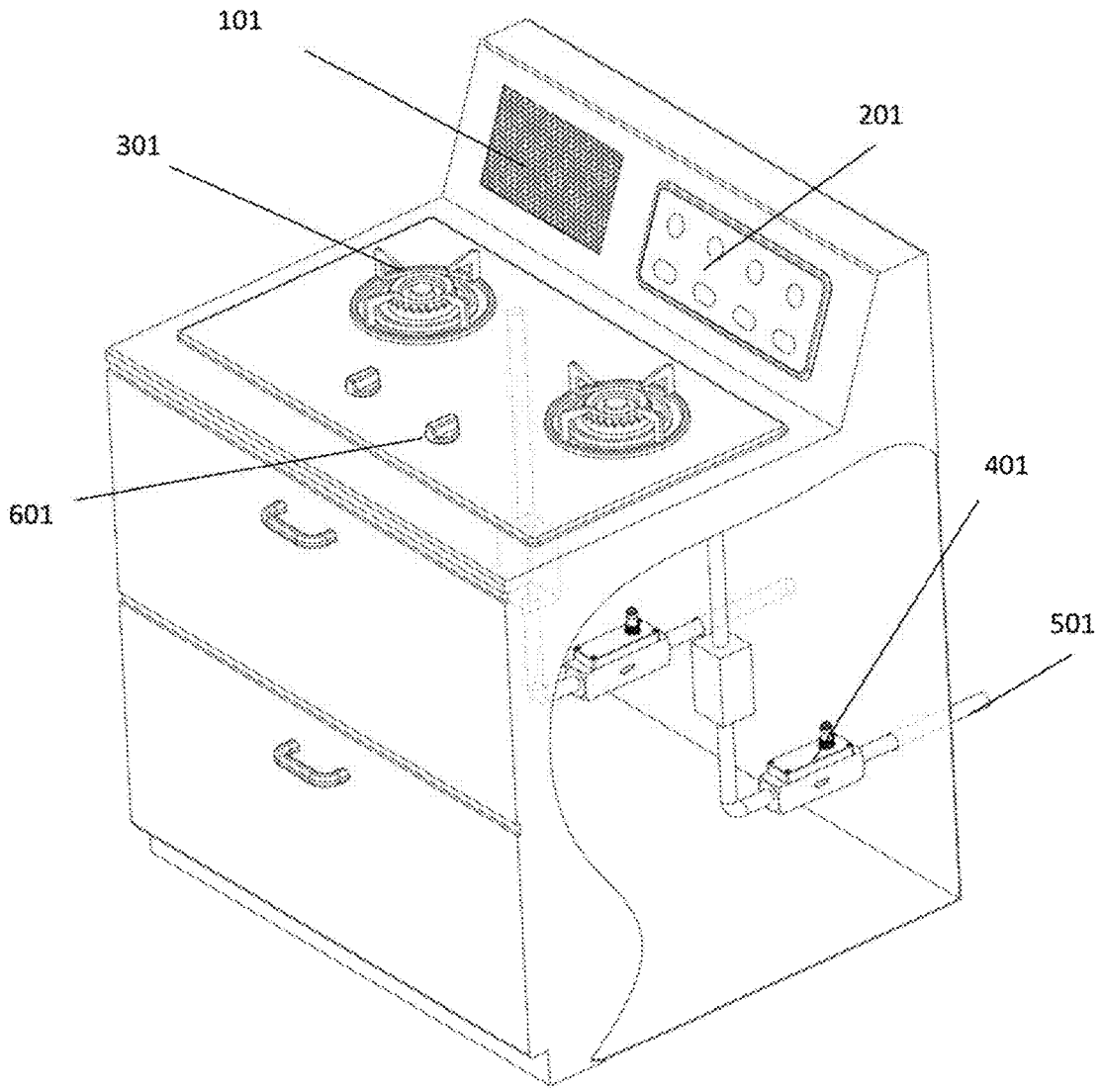
FIG. 1 is the schematics for the installation of the said smart device in a residential gas range product. For the optimal benefits, the said smart device shall be installed in serial in the pipeline connected to the each gas stove.
Figure 2:
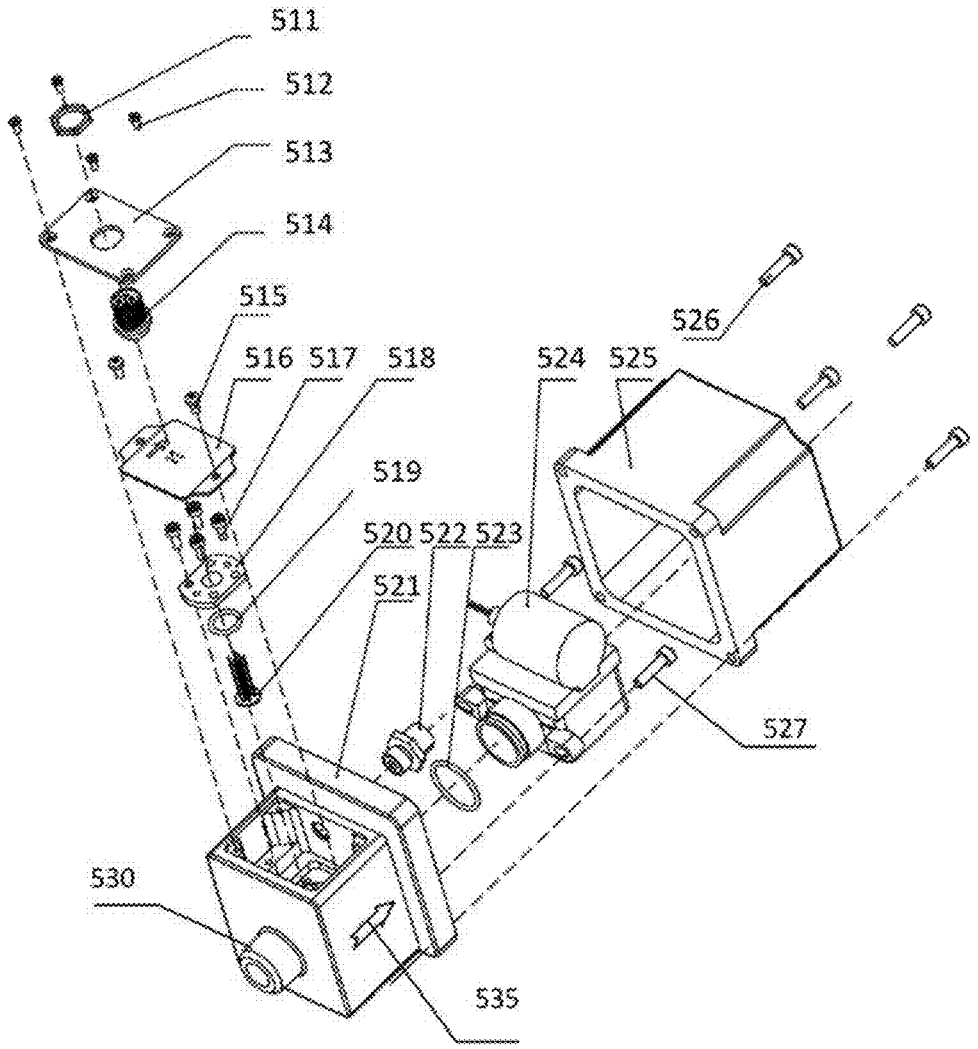
FIG. 2 is the detailed explosive view of the said smart device that shows each of the components of the said smart device with the assembly approach.

The preferred assembly of the said smart device of the said invention is shown in FIG. 2. The said smart device shall be composed of two major units, one is the metrology and control electronic unit 521, and another one is the electrically controllable valve, 524. The metrology and control electronic unit is composed of the MEMS mass flow sensor assembly 520 that contains the MEMS sensor chip and the printed circuitry board (PCB) with pins to the electronics on the PCB 516. The sensor assembly is placed on the wall of the flow channel 530 that also has a mechanical connector for installation onto the gas supply pipelines of the gas range. The flow director marker 535 indicated the installation orientation that shall be aligned to the gas flow direction in the gas supply pipelines of the gas range. The gasket 519 is used for the sealing to prevent gas leakage and the sealing metal block 518 shall be placed on the gasket and fastened by the four screws 517. The assembly is then followed by placing the electronics PCB 516 that is connected to the MEMS mass flow sensor assembly and is fixed to the device body by two screws 515. The electronics is further connected to an electrically controllable on/off valve 524 via the electrical socket connector 522 to enable the control of the on/off valve. The PCB 516 shall also contain a wireless transmitter as well as the wired connection to the network via the output and input interface connector 514. The cover 513 will be fixed to the device body via the four screws 512 and 511 is another screw that fixed the interface connector 514.

The electrically controllable on/off valve 524 was sealed for preventing gas leakage with the gasket 523, and fixed to the metrology and control electronics unit by the two screws 527. The electrically controllable valve is then sealed and covered by the electrically controllable valve cover 525 and further fastened by the screws 526. The flow channel inside the electrically controllable valve is also aligned to the flow channels on the metrology and electronic control unit in one end and another end of the flow channel inside the electrically controllable valve shall be used to connect to the gas range gas supply pipelines. After the assembly, the complete device shall be ready to install onto the gas supply pipelines and connect to network via the wired interface connector 514 or the embedded wireless module.

After installation of the said smart device in serial to the gas supply pipeline of the gas range, the said smart device shall either be powered by explosive proof battery or an external power should the wired network interface is connected to the external network. While the metrology and control electronics of the said smart device is designed and manufactured to be intrinsic safe, the battery power shall provide a standalone device while the wired interface connection to the external network can be isolated with a standard safety barrier such that the gas safety can be ensured at the operation.

Figure 3:
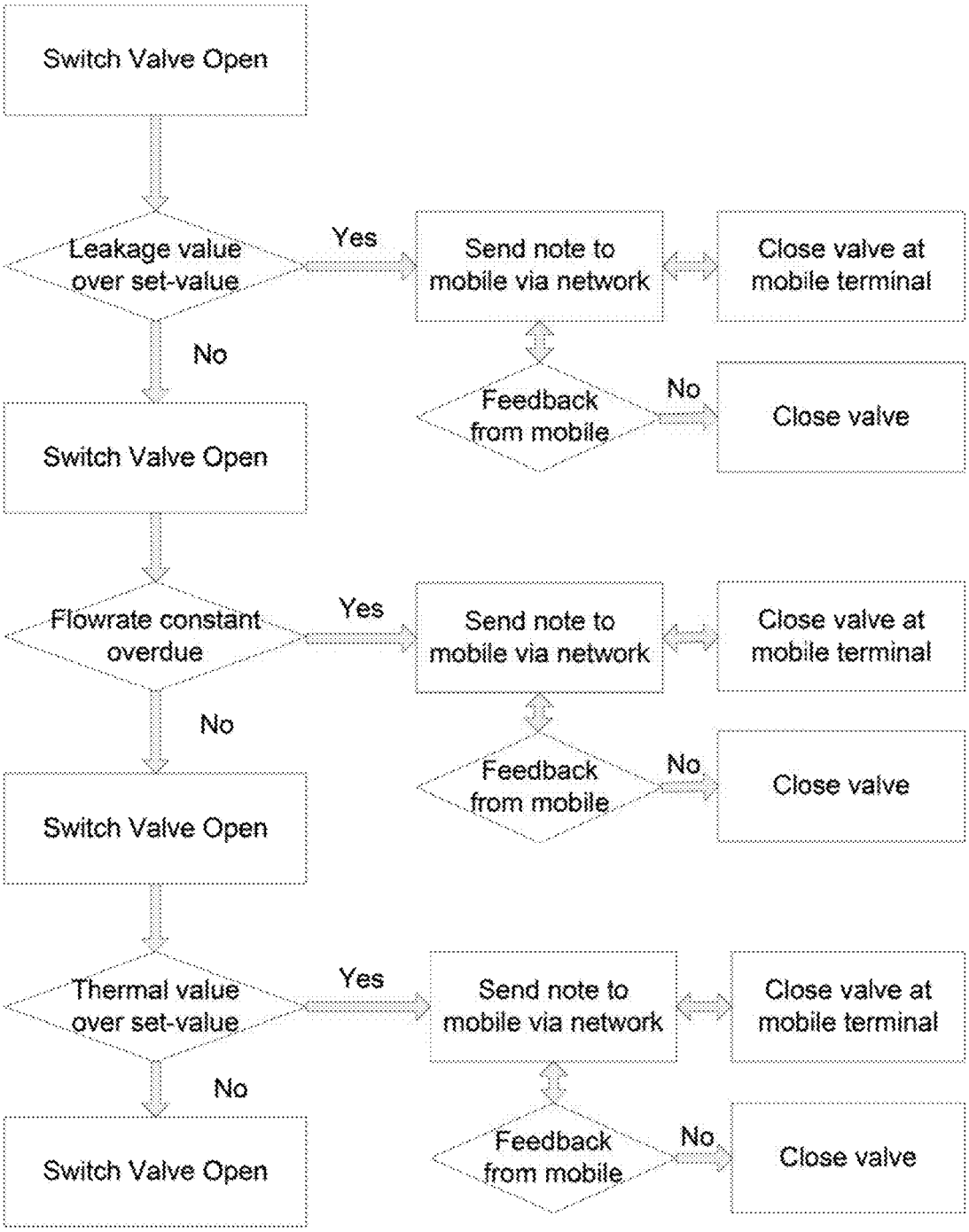
FIG. 3 is the process flow of the control schematics of the said smart device.

For the preferred embodiments, the actual sensing and control scheme of the said smart device attached in serial to the gas supply pipeline of the gas range is shown in FIG. 3. At the normal operation, the said smart device shall meter the gas flow rate in the supply gas pipeline to the gas range. For each type of gas range (commercial or residential), there would be a minimal gas flow rate required for the operation of the gas range. Therefore, user can set such a minimal flow rate in the said smart device as the operation flow rate limit. When the said smart device detects a constant flow below the operation flow rate limit, the said smart device shall send the current measured flow rate and a warning message of gas pipeline leakage to the mobile device of the user pre-paired to the said smart device via the wired or wireless network that connected to the said smart device. The user of the destined mobile device can then be alerted and read the current flow rate of the connected gas range from the mobile terminal and make decision of action to either remotely close the electrically controllable valve or call relevant party to have the immediate attention. At the end of the pre-set or pre-programmed time period of feedback signal, if the said smart device would not receive any feedback signal from the destined mobile device, the said smart device shall automatically execute the close valve procedure to close the electrically controllable valve to the gas supply pipeline. In the above preferred embodiment, the said smart device shall be able to prevent continuous gas leakage in the gas supply pipelines to the gas range for whatsoever reasons and enhance the safety of the gas range operation.

For the preferred embodiment, during normal operation of the said smart device, if the said smart device detects a constant flow rate that shall be above the minimal flow rate of the gas range operation at the end of a pre-set or pre-programmed time period, the said smart device shall send the current measured flow rate together with a warning message to the destined mobile device that is pre-paired to the said smart device via the wired or wireless network. The user of the destined mobile device can then be alerted and read the current flow rate of the connected gas range from the mobile terminal and make decision of action to either remotely close the electrically controllable valve or call relevant party to have the immediate attention. At the end of pre-set or pre-programmed time period for signal feedback, if the said smart device would not receive any feedback signal from the destined mobile device, the said smart device shall automatically execute the close valve procedure to close the electrically controllable valve to the gas supply pipeline. In the above preferred embodiment, the said smart device shall be able to intelligently complete the gas range operation at the desired status of the cooking substance and enhance the safety of the gas range operation.

For the preferred embodiment, during normal operation of the said smart device, the user can determine the required time period for preferred cooking substance by the metered thermal value of the supplied gas. In this preferred embodiment, the user shall be able to pre-set the time period at the time of starting the gas range. The said smart device shall then be operated at the gas thermal value detection mode. If the said smart device detects a constant flow rate that shall be above the minimal flow rate of the gas range operation at the end of a pre-set or pre-programmed time period, the said smart device shall send the current measured flow rate together with a warning message to the destined mobile device that is pre-paired to the said smart device via the wired or wireless network. The user of the destined mobile device can then be alerted and read the current flow rate of the connected gas range from the mobile terminal and make decision of action to either remotely close the electrically controllable valve or call relevant party to have the immediate attention. At the end of pre-set or pre-programmed time period for signal feedback, if the said smart device would not receive any feedback signal from the destined mobile device, the said smart device shall automatically execute the close valve procedure to close the electrically controllable valve to the gas supply pipeline. In the above preferred embodiment, the said smart device shall be able to prevent gas range from overheating or overcooking for whatsoever reasons and enhance the safety of the gas range operation.

The invention claimed is:

1. A smart device in serial connected to a gas supply pipeline of a commercial or residential gas range to have a capability of connecting to mobile devices via wired or wireless network, which can be utilized to metering a gas flow rate, to alert the connected mobile device, and to execute termination of the gas supply by the connected mobile device or automatically in a pre-set or pre-programmed period of time comprising:

A micro-machined or MEMS silicon mass flow sensor and a metrology electronics attached to the MEMS silicon mass flow sensor having a capability of metering fuel gas mass flow rate in a large dynamic range with a particular sensitivity for tracing fuel gas flow rate as well as the thermal property values of fuel gas;

An on/off valve that is controlled via the electronics associated to a fuel gas metrology electronics; wherein the on/off valve shall further be accessible by a pre-paired mobile device to execute valve function;

A communication interface such as an embedded wireless module that is connected to a mobile device via a pre-paring procedure as well as a data interface linked to the network via a wired connection;

A build-in control electronics that have a capability to control the on/off valve electrically for open and close functions based on the metrology data from the MEMS mass flow sensor; wherein the build-in control electronics can be further accessible by a pre-paired remote mobile device and execute commands from the mobile device; and A mechanical flow channel and enclosure that is used to house the MEMS mass flow sensor and the electrically controllable on/off valve as well as the control electronics; wherein the mechanical flow channel and enclosure will meet a safety requirements for commercial and residential application domain.

2. The smart device of claim 1 wherein said MEMS silicon mass flow sensor is able to metering the fuel gas with operating pressure up to 10 bar such that gas ranges can be operated for both commercial and residential applications with direct gas supply via the fuel gas pipes as well with fuel gas supplied by pressurized tanks; wherein the MEMS silicon mass flow sensor is operated at low power consumption with a surface protection passivation which meets the safety requirements for both commercial and residential fuel gas applications; wherein the MEMS silicon mass flow sensor has a capability of metrology standard in large dynamic range not smaller than 500:1 for detecting the fuel gas leakage in a preferably safety domain; and wherein the MEMS silicon mass flow sensor can metering the fuel gas thermal values via the measurement of the thermal capacitance and thermal conductivity of fuel gases; and wherein a measurement of the thermal property values is accomplished with the silicon mass flow sensor chip for the cost requirements in the residential gas range applications.

3. The smart device of claim 1 wherein the electrically controllable valve meets a safety requirement for low power consumption of the fuel gas operation in commercial and residential application domain; wherein the electrically controllable valve is made of materials such as engineering plastics or metal alloys that is resistive to corrosive gas agent; and wherein the electrically controllable valve meets gas leakage proof requirements in the fuel gas operation domain for both commercial and residential applications.

4. The smart device of claim 1 wherein said electrically controllable valve shall be an on/off valves commonly used in commercial and residential fuel gas appliances such as a pulse self-priming valve or an electrical motor valve.

5. The smart device of claim 1 wherein said communication interfaces are containing both wired and wireless capabilities; wherein the wireless interface can be accessed by nearby users without a necessary internet facility; wherein the wired interface enable users to access the smart device remotely and execute the desired commands accordingly; wherein the wireless interface can be a state-of-the art Bluetooth wireless module that can be pre-paired with a desired mobile devices for low power operation preference and data safety concerns; wherein the wired communication interface is in compliance with a current state-of-the art interact protocol, which can be connected into an existing mobile network by a desired pre-assigned mobile device with passcodes for data safety concerns.

6. The smart device of claim 1 wherein said control electronics is operated in a low power mode that will allow a standalone operation by a battery pack; wherein the control electronics will have a central process unit that can read fuel gas metrology data from the MEMS mass flow sensor and can execute pre-programmed or user entered commands to open and close the electrically controllable on/off valve; wherein the commands are entered via either wired or wireless interface on a printed circuit board with the control electronics; and wherein the control electronics can further relay information via the wired or wireless interface on the printed circuit hoard to interact with the pre-paired mobile device.

7. The smart device of claim 1 wherein the control electronics can record user entered gas leakage flow rate limit in accordance with manufactures' specification; wherein the control electronics can further compare gas flow rate status with a pre-set gas leakage limit; wherein when a constant leakage flow rate comparable or above the pre-set gas leakage flow rate limit, the control electronics will transmit current gas flow rate with an alert signal via the wired or wireless interface to the pre-paired destined mobile device and wait for a feedback from the destined mobile device; wherein during the pre-programmed time period, once the feedback is received, the control electronics will execute a corresponding command from the mobile device; and wherein if the feedback is not received at the end of a pre-programmed time period, the control electronics will execute an automatic command to close the associated electrically controllable valve such that gas supply to the connected gas range can be shut off and ensure operation safety of the gas range.

8. The smart device of claim 1 wherein said control electronics can record a user defined minimal gas operation flow rate in accordance with manufactures' specification; wherein the control electronics will further compare the gas flow rate status constantly with the pre-set gas leakage limit; wherein once a constant flow rate above the pre-set minimal gas operation flow rate is measured for an extended period of time that shall is pre-programmed by user, the control electronics will transmit current gas flow rate with an alert signal via the wired or wireless interface to the pre-paired destined mobile device and wait for the feedback from the destined mobile device; wherein during the pre-programmed time period, once a feedback from received, the control electronics will execute a corresponding command from the destined mobile device and wherein if the feedback is not received at end of the pre-programmed waiting period, the control electronics will execute an automatic command to close the associated electrically controllable valve such that gas supply to the connected gas range can be shut off and ensure operation safety of the gas range.

9. The smart device of claim 1 wherein said control electronics will record user-entered task data for certain cooking substance which is associated with a time period; wherein the time period is further associated to the gas thermal value that provides heating energy to change status of the desired cooking substance; wherein the control electronics can compare die gas thermal value and the user-entered time period on the gas range constantly based on the metered fuel gas thermal value data from the MEMS mass flow sensor; wherein once a pre-programmed time period concluded, the control electronics will transmit a current task status with an alert signal via the wired or wireless interface to the pre-paired destined mobile device and wait for a feedback from the destined mobile device; and wherein during the pre-programmed time period, once a feedback is received, the control electronics will execute corresponding commands from the destined mobile device; and wherein if the feedback is not received at the end of the pre-programmed time, the control electronics will execute an automatic command to close the associated electrically controllable valve such that the gas supply to the connected gas range can be shut off and ensure the safe operation of the gas range.

10. The smart device of claim 1 wherein said mass flow sensor is placed on the sidewall of a flow channel with a desired size in accordance with the gas range specifications; wherein the flow channel is having a Venturi structure that will improve flow stability within a desired dynamic flow range; wherein a flow channel will further be integrated with a housing for the control electronics and the electrically controllable or off valve; and wherein those materials of the complete enclosure are made of metal alloys such as aluminum alloy in accordance with gas safety requirements.

* * * * *